US005129316A

United States Patent [19]

Calderon

[11] Patent Number: 5,129,316

[45] Date of Patent: Jul. 14, 1992

[54] COMBINATION HOMOGENIZER-VACUUM LOADER FOR MEAT PRODUCTS

[76] Inventor: Alexander Calderon, 45208 S. Grimmer Blvd., Fremont, Calif. 94539

[21] Appl. No.: 647,462

[22] Filed: Jan. 28, 1991

[51] Int. Cl.[5] ..... B01F 7/00

[52] U.S. Cl. ..... 99/472; 99/348; 366/139; 366/249; 366/314; 426/519; 452/35

[58] Field of Search ..... 366/134, 139, 244, 249, 366/292, 314; 99/348, 472; 426/519, 129; 452/35

[56] References Cited

U.S. PATENT DOCUMENTS

| | | | |
|---|---|---|---|
| 4,498,378 | 2/1985 | Norrie et al. | 366/139 |
| 4,522,118 | 6/1985 | Simonsen et al. | 366/139 |
| 4,952,065 | 8/1990 | Kreuziger | 366/139 |
| 4,981,365 | 1/1991 | Bow et al. | 366/139 |

*Primary Examiner*—George Yeung
*Attorney, Agent, or Firm*—Robert Charles Hill

[57] ABSTRACT

A combination homogenizer-vacuum loader for a machine that stuffs meat product into a casing which includes an upright cylindrical chamber that can be evacuated and an agitator assembly that is rotated inside the chamber. An entrance port with a sliding gate valve is located on the side of the chamber so that when the valve is opened, ground meat is drawn by vacuum into the chamber. An exit port is located on the floor of the cylinder. The agitator assembly is detachably mounted on one end of a spindle having its other end external to the chamber for attachment to a drive means. A number of agitator assemblies are provided, each having a configuration designed to homogenize a particular meat product having its own consistency, depending on content of fat, moisture, and fiber.

11 Claims, 3 Drawing Sheets

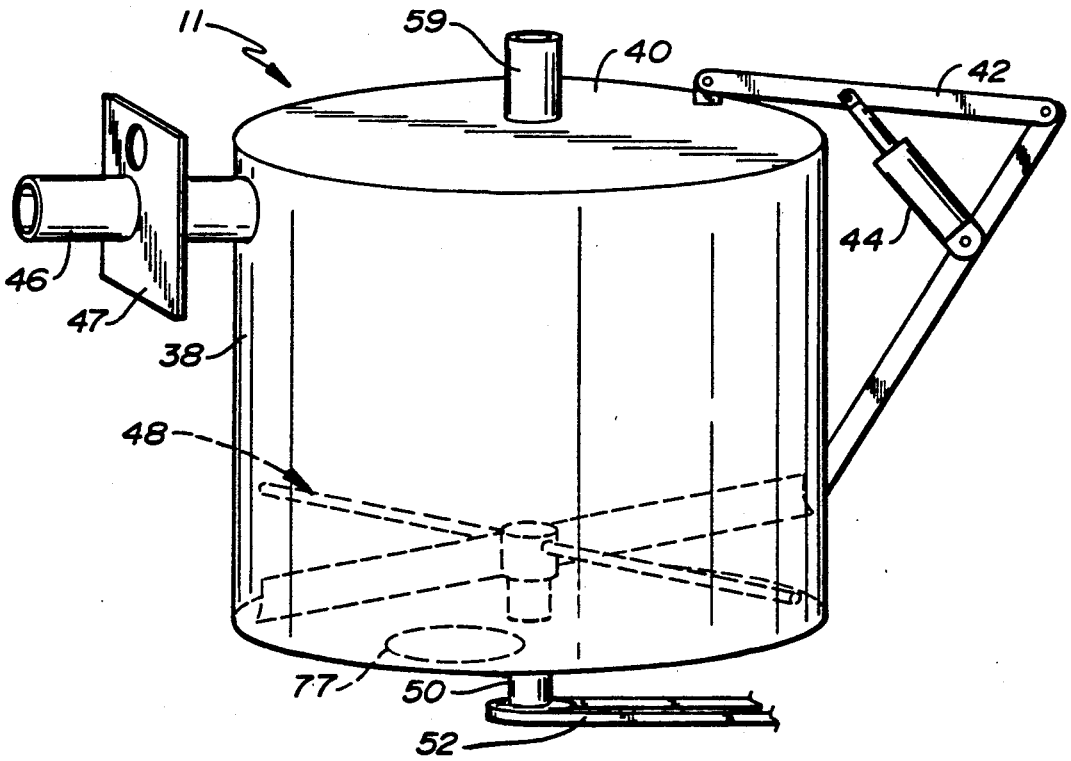
FIG._4
FIG._5
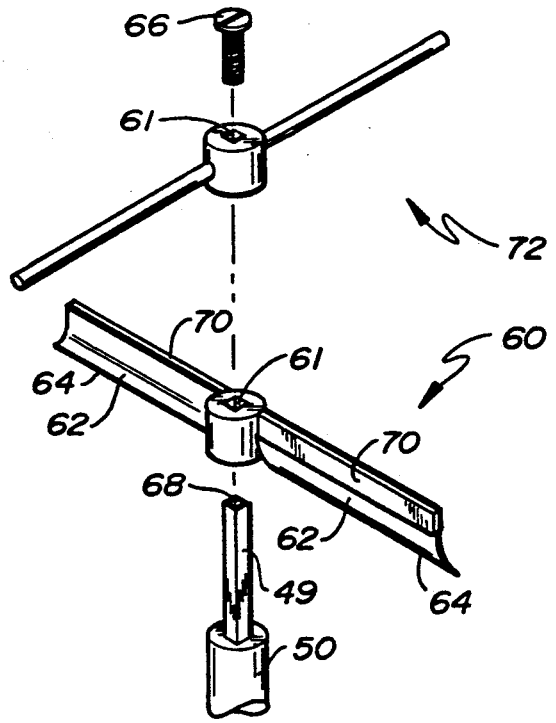

COMBINATION HOMOGENIZER-VACUUM LOADER FOR MEAT PRODUCTS

FIELD OF THE INVENTION

This invention relates to machines for stuffing meat product into casings and particularly to an adapter to a meat product stuffing machine that provides a very homogeneous meat product stuffed into the casing together with the convenience of vacuum loading.

BACKGROUND AND INFORMATION DISCLOSURE STATEMENT

For many years, meat has been sold as sausages or loaves wherein meat product is stuffed into a casing. The casings were originally the intestine of the animal. In more recent years, synthetic casings have been offered in the market.

In the context of this specification, the term, meat product, is understood to mean a wide assortment of meat preparations, including ground beef, dismembered poultry, etc. These various assortments would obviously present a wide consistency due to variation in content of fat, moisture, size of meat fiber, size of meat chunks, etc.

The quality of the meat product is determined not only by the meat but by the quality and homogeneity of the loaf. Homogeneity is determined by the stuffing process, i.e., how well the meat product is mixed and how effectively air is removed from the meat product which otherwise collects to form voids. In former times, stuffing was performed manually so that inhomogeneity, compared to present standards, was very poor.

As the demand for the number and quality of meat product loaves increased, machines have been developed to stuff the meat product. The first machines, illustrated in FIG. 1, included an air-actuated ram to stuff meat product drawn down from a conical hopper and out through a "horn". The casing is placed over the horn to receive the meat product that is passed through the horn. The upper large rim of the conical hopper is typically twelve feet above the floor so that one of the inconveniences of using this machine is having to lift the meat product up to this height in order to fill the hopper.

As shown in FIG. 2, in the next generation of machines the piston was replaced by a vane pump or small screw, and a vacuum was added adjacent to the horn so that the casing was partially evacuated and the meat product was thereby drawn into the casing.

As shown in FIG. 3, in order to facilitate loading the meat product by not having to lift the meat product up to the rim, machines were developed with an evacuated upper chamber into which meat product was drawn by vacuum. The chamber contained a large screw which directed the meat product toward the chamber exit so that the meat product was stuffed through the horn into the casing using a combination screw and vacuum. Although the vacuum in the chamber helps to homogenize the meat product by withdrawing entrapped air, the use of a large screw (auger) to force the meat product into the exit port compacts the meat product and thereby obstructs the desired homogenizing of the meat product. These machines have the additional problem that fat tends to collect on the blade leading to inhomogeneity of the meat product. The construction of these machines takes frequent cleaning of the screw (necessitated by the collection of fat thereon) which is very time-consuming and inconvenient.

None of the machines discussed in the foregoing paragraphs addresses the problem of preparing meat product and stuffing the meat product into a casing where the meat product has been homogenized to an optimum consistency regardless of the initial condition of the meat product with respect to content of moisture, fat, fiber length, air pockets or gross inhomogeneity.

THE INVENTION

Objects

It is an object of this invention to provide an apparatus for homogenizing meat product to be stuffed into a casing.

It is a further object that the stuffed meat product be much more homogeneous with regard to the distribution of fat and absence of air pockets than is provided by machines of the prior art.

It is another object to avoid the problem of collection of fat on a screw such as experienced with machines of the prior art and to provide an apparatus that is convenient to clean.

It is another object of this invention to provide an agitator to be used in conjunction with vacuum in order to provide homogenization that is superior to that provided by machines of the prior art.

It is another object that the construction of the apparatus be amenable to conveniently interchanging agitators having various styles, each style designed to optimize homogenization of a particular meat product having its own unique consistency.

It is another object to provide an apparatus that may be retrofitted to the old style (toploaded) meat product stuffing machines to provide convenience of loading and cleaning and homogeneity of stuffed meat product that is superior to machines of the prior art.

SUMMARY

This invention is directed toward a meat product homogenizer in which meat product is drawn into a vacuum chamber. The chamber has a rotary agitator that stirs the meat product to facilitate removal of entrapped air and mixing of fat homogeneously throughout the meat product. The agitator then directs the homogenized meat product through an exit port to a meat product stuffing machine that comprises a small auxillary screw or vane pump to force the ground meat through a horn into a casing.

The homogenizer of this invention includes a vacuum chamber containing an agitator which replaces the conical hopper of the prior art machine, thereby upgrading the prior art machine with regard to providing improved homogenization and vacuum loading of meat product.

In its preferred construction, the chamber is cylindrical (oriented in the upright position) and has a bottom floor and top hinged lid. A spindle passes through the floor into the center of the cylindrical chamber. The end of the spindle is a square nub so that various agitator assemblies having a matching square central opening may be mounted onto the end of the spindle inside the chamber. The other end of the spindle extending externally through the floor of the chamber is coupled to a drive motor. The floor of the chamber has a large exit port permitting the meat product to pass from the homogenizer to the loading cylinder of the meat product stuffing machine then out through an exit horn into the casing. The rotating agitator assembly has two sections, i.e., a scraper member and a homogenizing member, both mounted at their respective centers to rotate on the spindle. The homogenizer member mounted above the scraper member directs the meat product toward the rotating scraper member which has a sweeping action against the bottom of the chamber and continually directs the meat product toward the exit port in the floor of the chamber. An entry port is provided on the cylindrical wall of the chamber that has a slide valve that may be opened to permit flow of meat product into the chamber. A lid covers the entire top end of the chamber and the lid is hinged to the outside of the cylinder such that the lid may be lifted off the top of the cylinder when it is required to clean the inside of the chamber or exchange homogenizer members. The lid is lifted by means of a hydraulic ram positioned against the hinge.

In order to retrofit existing machines of the prior art with the combination homogenizer-vacuum loader apparatus of this invention, the conical hopper of the prior art machine is removed and the homogenizer is set on top of the machine with the exit port of the chamber aligned to an entrance port to the stuffing machine where the conical hopper was originally located. The joint between the exit port of the homogenizer and the entrance port of the stuffing machine is sealed by an elastomeric gasket. Parameters of the homogenizing operation such as speed of rotation of the agitator assembly, time of homogenizing, and the actual homogenizer attached to the agitator assembly are selected according to the nature of the meat product, such as fat and moisture content, nature of the meat fiber, etc. Optimum homogenization of meat product is determined in terms of achieving a desired consistency, improved color, absence of holes, longer shelf life, etc. Shelf life can be doubled by optimum homogenizing conditions.

DRAWINGS

FIG. 4 shows the homogenizer apparatus of this invention.

FIG. 5 shows details of the design of the homogenizer member of an agitator intended for meat having average initial consistency.

DESCRIPTION OF THE PREFERRED EMBODIMENT

The following detailed description illustrates the invention by way of example, and not by way of limitation of the principles of the invention. This invention will clearly enable one skilled in the art to make and use the invention and describes embodiments, adaptations, and uses including what I presently believe is the best mode for carrying out the invention.

Figure 1:
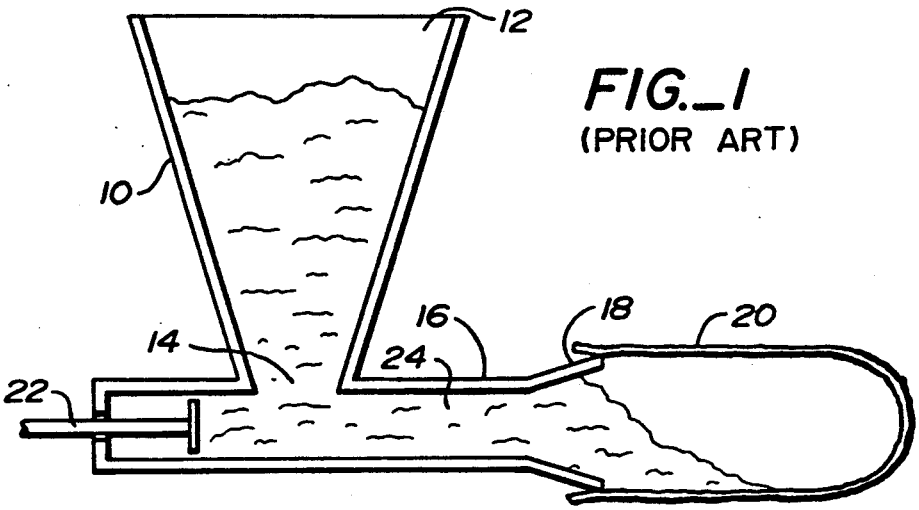
FIG. 1 (PRIOR ART)
FIG. 1 is a sectional view of the first type of prior art machine for stuffing meat product into a casing using a ram.

Turning now to the drawings, FIG. 1 shows a sectional view of the operating principles of the first meat product stuffing machines. There is shown a conical loading hopper 10 with the top opening 12 where the meat product is loaded into the machine and the hopper exit port 14 where the meat product leaves the conical hopper 10 to enter the loading cylinder 16. One end of the loading cylinder 16 has a flared horn 18 which mates to the opening of a casing 20. At the other end of the loading cylinder 16 is an air actuated ram 22 which forces the ground meat 24 into the casing 20.

Figure 2:
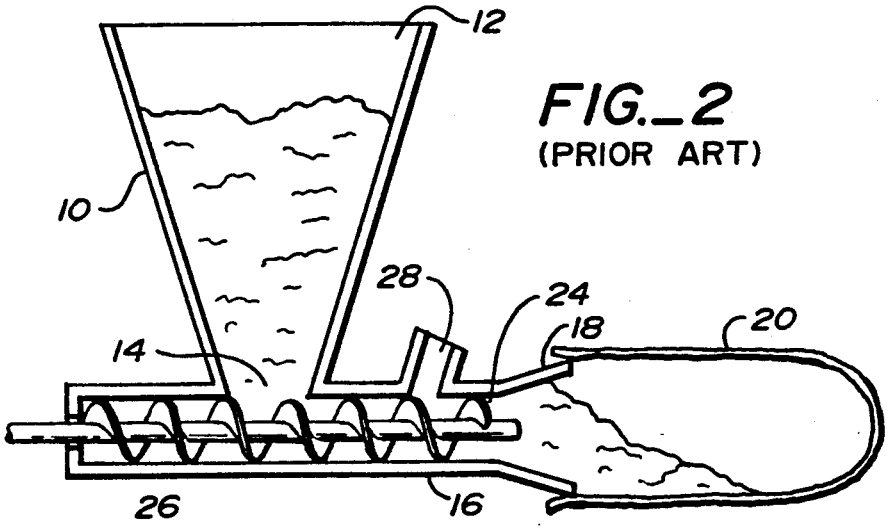
FIG. 2 (PRIOR ART)
FIG. 2 is a sectional view of the next generation machine which evacuated the casing and drew the meat product toward the casing by vacuum source located close to the horn.

FIG. 2 shows a sectional view of the next generation machine which introduces vacuum loading of the meat product into the casing. A vane pump or screw 26 has replaced the ram 22 of FIG. 1 to drive the meat product into the casing 20. A port 28 is located close to the horn which facilitates loading the casing 20 by evacuating the casing 20 and helping to draw the meat product from the conical loading hopper 10 down into the entrance 58 of the loading cylinder 16.

Figure 3:
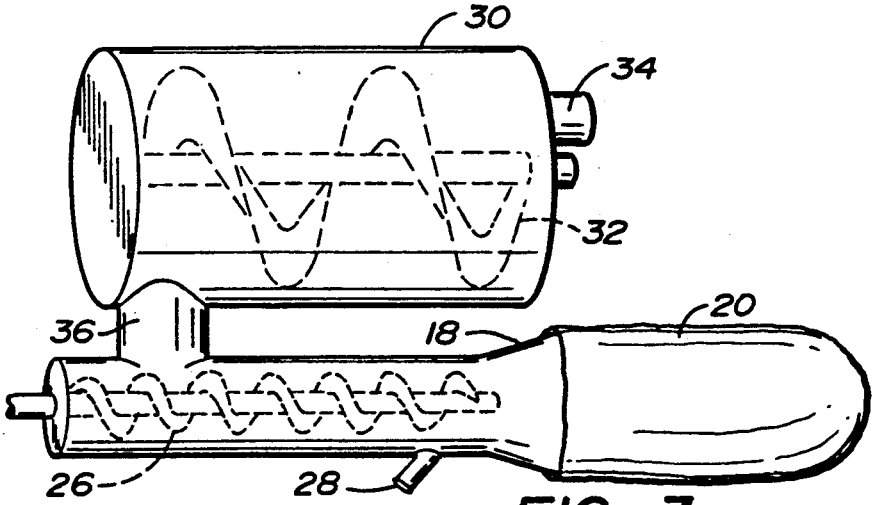
FIG. 3 (PRIOR ART)
FIG. 3 shows the next generation machine that used vacuum to load the meat product into the hopper and a screw to transfer the meat product from the hopper to the vane pump.

FIG. 3 illustrates the third generation machine which features vacuum loading of the ground meat into the loading hopper 30 in addition to vacuum-aided loading of the casing. The loading hopper is a cylinder 30 with its axis oriented horizontally. Meat product is loaded by vacuum into the cylinder through the entry port 34. The meat product is driven toward the exit 36 of the chamber 30 by screw 32. The casing 20 is stuffed by combined action of a small screw or vane pump 26 and vacuum through port 28 located near the loading horn 18.

FIG. 4 shows one embodiment of the homogenizer 11 of meat product which is included in the scope of the present invention. There is shown a cylindrical hopper 38, with a lid 40 that may be lifted off by hinge 42 actuated by hydraulic ram 44 for cleaning and access to the interior chamber of the hopper 38. Meat product is vacuum-loaded into the chamber 38 through a side port 46. An agitator assembly 48 that rotates to homogenize the meat product in cooperation with the vacuum is mounted on a spindle 50. The spindle includes a square end section 49 attached to section 50, having a circular cross-section which extends through the bottom wall of the hopper 38 and is coupled by belt 52 to a drive motor (not shown). In order to adapt the homogenizer of FIG. 4 to the machine of the prior art shown in FIG. 2, the conical hopper 10 shown in FIG. 2 is removed and replaced by the homogenizer 11 of FIG. 4, with the exit port 77 in mating alignment with the entrance to the stuffing machine (not shown).

An inlet 59 communicating with a source of vacuum (not shown) is provided for evacuating the chamber and is located in the lid of the hopper 38. The chamber is evacuated typically to twenty-nine inches of mercury.

The entrance port 46 is provided with a sliding gate valve 47. When it is desired to load meat product into the chamber, gate valve 47 is opened so that the vacuum in the chamber draws meat product through the entrance port 46. The valve 47 is then closed to maintain the vacuum in the chamber.

The agitator assembly, shown in the exploded view of FIG. 5, comprises a lower scraper member 60 oriented perpendicularly to an upper homogenizer member 72. Both members have centrally located square mounting holes 61 for attachment to the square end section 49, attached to round section 50 of the spindle, and are secured by screw 66 in threaded hole 68 of the spindle. Scraping member 60 includes a rigid support 70 supporting a slightly flexible scraper blade 62 whose bottom edge 64 is in contact with the chamber floor at all times, and sweeps the homogenized meat product into the exit port 77 in the floor of the chamber which communicates with the entrance to the stuffing machine.

The upper homogenizer member 72 has a square hole 61 through its center that mates with the square end 49 of the spindle. The homogenizer member may therefore be readily separated from the spindle and removed from the chamber. This provides that various designs of homogenizer members can be installed in the homogenizer depending on the consistency and composition of the meat product to be homogenized. If meat product is excessively agitated, then it becomes "pasty". Various designs of homogenizer members are shown in FIGS. 5 and 6.

The homogenizer member shown in FIG. 5 is simply a bar and is used on meat product having a moderate fat content and moderate juiciness.

If the meat product is very juicy and has little fat, then no homogenizer member would be used and a stud would be placed over the end of the spindle as protection for the threaded hole 68 at the square end section 49 of the spindle.

Figure 6:
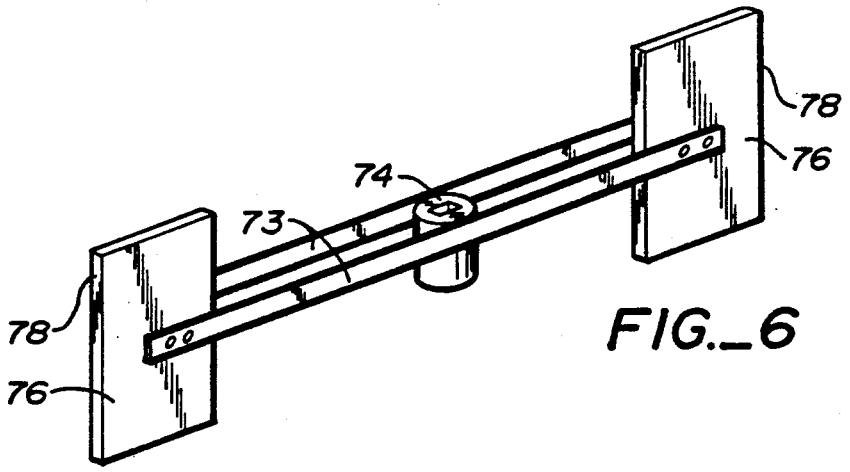
FIG. 6 shows details of the design of a homogenizer member that is useful on meat product having a high fat content.

As shown in FIG. 6 if the meat product is very fat, then a homogenizer member is used that includes outrigger support members 73 mounted on central sleeve 74 and to whose ends are secured wiper members 76. The outer edges 78 of wiper members 76 are in continual contact with the interior cylindrical wall of the chamber so as to prevent any buildup of fat.

The wiper members 76 and scraper blades 62 are made preferably of high density polyethylene.

Figure 7:
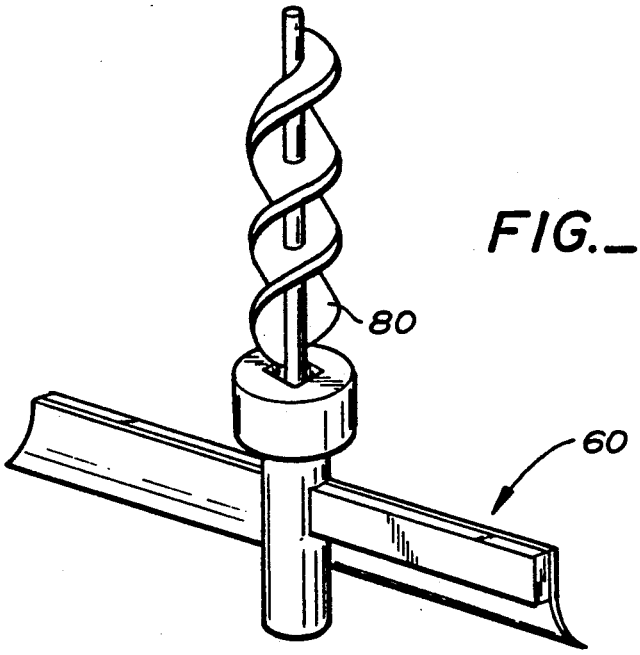
FIG. 7 shows details of a homogenizer member to be used where the initial ground mix has large regions of various consistencies, thereby requiring extensive mixing.

As shown in FIG. 7, if the meat product requires a relatively long time for homogenization, such as when there are large regions of varying composition or consistency, then an auger 80 may be attached to the spindle concentric with the spindle that circulates the meat product up from the bottom of the chamber.

Another method of controlling the homogenizing action is by adjusting the speed of rotation. Rotational velocity is variable from zero to twenty-five revolutions per minute. Long fiber meat products, such as those containing beef, are typically homogenized in the lower range of rotational velocity. Short fiber meat products, such as those containing chicken, are typically homogenized in the higher range of rotational velocity.

Figure 8:
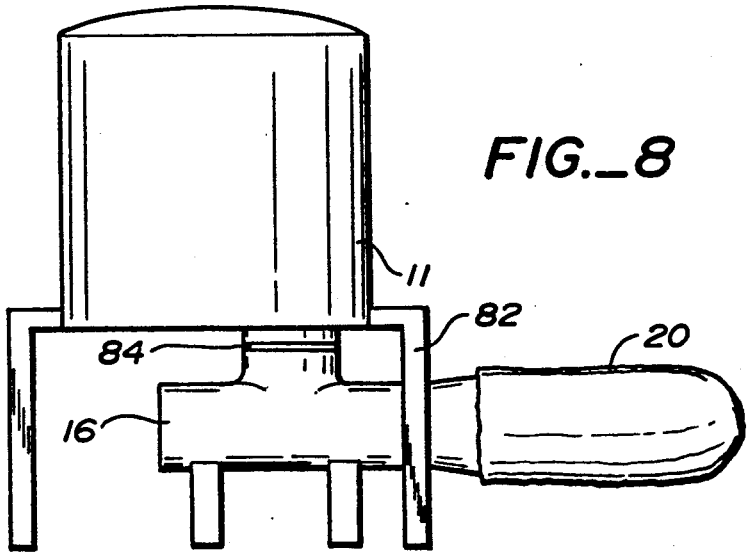
FIG. 8 shows the combination homogenizer-vacuum loader of this invention retrofitted to an existing machine.

As shown in FIG. 8 an important embodiment of this invention is the ability to adapt the homogenizer to meat product stuffing machines of the type shown in FIGS. 1 and 2. For this purpose, the original conical hopper of the machine is removed. The homogenizer 11, supported on a frame 82, is positioned on top of the machine of the prior art to be retrofitted with the exit opening of the homogenizer communicating directly with the entrance opening of the machine to be retrofitted. A metal ring 84 supporting a rubber gasket (not shown) is interposed between the outer surfaces of the homogenizer and meat product stuffing machine in order to seal the union homogenizer to meat stuffing machine and maintain vacuum in the chamber of the homogenizer. The homogenizer unit is hinged to the frame 82 (hinge not shown) in order that the homogenizer unit may be lifted and positioned onto the stuffing machine 16. An acceptable material for the gasket is neoprene, U.S.D.A.-approved.

In the foregoing paragraphs, a combination homogenizer-vacuum loaded for a meat product stuffing machine has been described which meets the objects of the invention. The apparatus includes a chamber that is evacuated to accomplish the two jobs of loading the meat product and removing air pockets. The apparatus is constructed so that one of several styles of homogenizer members can be conveniently installed to cooperate with the vacuum in the chamber to homogenize the meat product wherein the style of homogenizer member is selected depending on the initial characteristics of the meat product regarding content of moisture, fat, and nature of the fiber. Homogenizing parameters can be further "fine tuned" by selecting an appropriate speed for the revolving agitator.

I claim:

1. An apparatus for homogenizing meat product which comprises:

a cylindrical chamber with a vertically oriented axis having a floor on a bottom end and an enclosing wall section on a top end;

means for connecting said chamber to a source of vacuum;

a spindle having a first end located outside said chamber and attached to a means to rotate said spindle, said spindle extending through said floor, thereby providing that a second end of said spindle is located within said chamber;

a means for agitating meat product;

means for detachably mounting said agitation means on said second end of said spindle;

said chamber having an entrance port means for a source of meat product, thereby providing that meat product is drawn by vacuum into said chamber;

said floor having an exit port means where meat product is discharged after it has been homogenized;

said exit port being located in an area of said floor where said agitator sweeps said homogenized meat product into said exit port.

2. An apparatus as in claim 1 wherein said detachably mounting means is a shape of said second end of said spindle operably configured to mate with a hole in said agitating means, thereby providing that said agitating means will rotate with said rotating spindle and that said agitator means may be withdrawn from said spindle when required.

3. An apparatus as in claim 1 wherein said agitator means comprises:

a scraper member which includes a blade member having a central section with a hole configured to mate with said second end of said spindle and an overall length substantially equal to a diameter of said cylindrical chamber;

said blade member operably configured and located to provide that, when said spindle rotates, said blade member prevents fatty materials from accumulating on said floor and sweeps meat product that has been homogenized into said exit port means.

4. An apparatus as in claim 3 wherein said agitator means further comprises:

a homogenizer member having an elongated length with two ends and a center section;

said center section having a hole operably configured to mate with said shape of said second end of said spindle and to orient said length perpendicular to said spindle.

5. An apparatus as in claim 4 wherein said homogenizer member further comprises:

two scraper members, each scaper member attached to one said end of said homogenizer member; p1 each said scraper member having an edge and said scraper member oriented to permit said edge to scrape fat deposit from said wall of said chamber.

6. An apparatus as in claim 4, wherein said homogenizer member is a bar.

7. An apparatus as in claim 4 wherein said agitator means further comprises an auger member operably constructed for attachment to said second end of said spindle with an axis of said auger member coincident with an axis of said spindle, thereby providing that said meat product is stirred up from mear the center of said floor when said spindle rotates.

8. An apparatus as in claim 1 wherein said entrance port means comprises an entrance gate valve to provide that said entrance gate valve may be closed in order to maintain vacuum in said chamber and opened when it is required to draw meat product into said chamber from said source of ground meat.

9. An apparatus as in claim 1 wherein said top enclosing wall section is a lid hingeably attached to said cylinder.

10. An apparatus as in claim 9 which comprises hydraulic means for opening said lid.

11. An apparatus for homogenizing meat product which comprises:

a housing including a wall that encloses a chamber; means for connecting said chamber to a source of vacuum;

a spindle having a first end located outside said chamber and attached to a means to rotate said spindle, said spindle extending through said wall, thereby providing that a second end of said spindle is located within said chamber;

a means for agitating meat product;

means for detachably mounting said agitating means on said second end of said spindle;

said wall having an entrance port means for a source of meat product, thereby providing that meat product is drawn by vacuum into said chamber;

said wall having an exit port means where meat product is discharged after it has been homogenized; said exit port being located in an area of said wall where said agitator sweeps said homogenized meat product into said exit port;

a meat product stuffing cylinder having an entrance passage communicating with said exit port of said homogenizer;

a rotatable screw inside of and coaxial with said meat product stuffing cylinder; and said meat product stuffing cylinder operably constructed to provide an open end of said cylinder which communicates with a casing attached to said meat product stuffing cylinder.

* * * * *